US009926692B2

(12) United States Patent
McAlpine

(10) Patent No.: US 9,926,692 B2
(45) Date of Patent: Mar. 27, 2018

(54) URINAL APPARATUS

(75) Inventor: James Edward McAlpine, Glasgow (GB)

(73) Assignee: McAlpine & Co. Ltd., Glasgow (GB)

( * ) Notice: Subject to any disclaimer, the term of this patent is extended or adjusted under 35 U.S.C. 154(b) by 1297 days.

(21) Appl. No.: 12/679,783

(22) PCT Filed: Sep. 25, 2008

(86) PCT No.: PCT/GB2008/003238

§ 371 (c)(1),
(2), (4) Date: Apr. 8, 2010

(87) PCT Pub. No.: WO2009/040524

PCT Pub. Date: Apr. 2, 2009

(65) Prior Publication Data

US 2010/0205725 A1 Aug. 19, 2010

(30) Foreign Application Priority Data

Sep. 25, 2007 (GB) ..... 0718708.1
Dec. 22, 2007 (GB) ..... 0725125.9

(51) Int. Cl.

| | |
|---|---|
| ***E03D 13/00*** | (2006.01) |
| ***E03C 1/298*** | (2006.01) |
| ***E03C 1/264*** | (2006.01) |
| ***E03C 1/28*** | (2006.01) |

(52) U.S. Cl.

CPC ..... *E03C 1/298* (2013.01); *E03C 1/264* (2013.01); *E03C 1/281* (2013.01); *E03D 13/005* (2013.01)

(58) Field of Classification Search

USPC ..... 4/144.1, 695, 426

See application file for complete search history.

(56) References Cited

U.S. PATENT DOCUMENTS

| | | | | |
|---|---|---|---|---|
| 3,047,013 | A * | 7/1962 | Baumbach | 137/849 |
| 5,711,037 | A | 1/1998 | Reichardt et al. | |
| 6,401,266 | B1 * | 6/2002 | Mitchell et al. | 4/309 |
| 6,973,939 | B2 * | 12/2005 | Gorges et al. | 137/315.41 |
| 7,575,022 | B2 * | 8/2009 | Higgins | 137/558 |
| 7,636,957 | B2 * | 12/2009 | Funari | E03C 1/281 4/144.1 |

(Continued)

FOREIGN PATENT DOCUMENTS

| | | |
|---|---|---|
| CH | 636923 | 6/1983 |
| EP | 1174549 | 1/2002 |
| EP | 1174549 A2 * | 1/2002 |

(Continued)

OTHER PUBLICATIONS

The EP 1174549.*

(Continued)

*Primary Examiner* — Lauren Crane
(74) *Attorney, Agent, or Firm* — Colby Nipper PLLC

(57) ABSTRACT

An apparatus for a urinal is described. The apparatus comprises a plate member adapted to form a seal with a urinal outlet, the plate member defining a throughbore permitting the passage of liquid, in use, from the urinal to a soil pipe and a diaphragm located in the plate member throughbore, the diaphragm adapted to permit the passage of liquid through the throughbore in one direction only from the urinal to the soil pipe.

14 Claims, 9 Drawing Sheets

(56) References Cited

U.S. PATENT DOCUMENTS

2006/0207005 A1* 9/2006 Janssen ..... 4/310

FOREIGN PATENT DOCUMENTS

| | | |
|---|---|---|
| EP | 1188870 | 3/2002 |
| EP | 1785077 | 5/2007 |
| GB | 99/07953 | 2/1999 |

OTHER PUBLICATIONS

International Search Report for PCT/GB2008/003238.
United Arab Emirates Examination Report, Application No. UAE/P/0381/2010, dated May 7, 2017, 17 pages.
United Arab Emirates Search Report, Application No. UAE/P/0381/2010, dated May 7, 2017, 4 pages.
Australian Examination Report, Application No. 2008303367, dated Dec. 20, 2013, 4 pages.
Australian Examination Report, Application No. 2008303367, dated Mar. 30, 2015, 4 pages.
Australian Examination Report, Application No. 2008303367, dated Aug. 25, 2015, 4 pages.

* cited by examiner

URINAL APPARATUS

FIELD OF THE INVENTION

The present invention relates to an apparatus for a urinal, particularly, but not exclusively to a fitting for a low water usage urinal.

BACKGROUND OF THE INVENTION

Waterless or low water usage urinals have become more popular in recent years as the financial and environmental cost of supplying water becomes more important to water consumers. A number of different technologies are used in waterless urinals.

For example, in some cases, a conventional U-bend is used which utilises urine to provide a liquid barrier in the trap to prevent odours from the soil stack being emitted through the urinal.

There is a perception with urine barrier arrangements that the urine in the trap can itself result in unpleasant odours around the urinal. To alleviate this, one-way valves, such as duckbill valves, have been used to prevent the backflow of odours and, in the eventuality of a blockage, liquids.

The one-way valves on the market have drawbacks. For example, to provide sufficient sealing performance they are relatively long. In the confined space below a urinal it is sometimes necessary for these valves to be installed in a horizontal plane rather than in the vertical plane due to their length. Installation in a horizontal plane has a detrimental effect on the valve's efficiency. In addition, the conventional one-way valve can be awkward to marry-up to existing pipe work and, in some cases, to remove the valve for cleaning or replacement requires dismantling of the pipe work. As this pipe work can sometimes be concealed within the urinal, dismantling can be both awkward and time consuming.

In further cases, a urinal is adapted to receive a cartridge which is installed in a chamber at the base of the urinal. The cartridge contains a sealant liquid, usually an oil, which acts as a barrier between the urinal and the soil stack. When urine enters the urinal, the urine can pass through the sealant liquid and into the soil stack.

However, such waterless urinals have disadvantages. For example, the use of oil may be considered to be environmentally unfriendly and oil has associated disposal issues. There is also a significant amount of material in the cartridge which has to be replaced in its entirety periodically.

SUMMARY OF THE INVENTION

According to a first aspect of the present invention there is provided a fitting for a urinal, comprising:

a housing body defining a throughbore, the housing body having an inlet adapted to receive liquid from a urinal bowl and an outlet adapted to be connected to a waste pipe; and a diaphragm removably locatable in the housing throughbore, the diaphragm adapted to permit the passage of liquid through the throughbore in one direction only from the inlet to the outlet;

wherein, in use with a urinal bowl, the diaphragm is removable from the housing through a urinal bowl outlet.

A urinal fitting, according to an embodiment of the present invention, permits the diaphragm to be removed from the housing through the urinal outlet. This is advantageous if, for example, the diaphragm needs replacing or cleaning, because removal does not require dismantling of the pipe work associated with the valve. This is particularly advantageous it the pipe work is concealed in a cavity defined by the urinal bowl and the wall to which the bowl is mounted, because to remove the diaphragm does not require removal of the urinal bowl from the wall.

Preferably, the diaphragm is a duckbill valve.

Preferably, the diaphragm has a longitudinal axis.

Preferably, the diaphragm longitudinal axis is parallel to the throughbore longitudinal axis.

Preferably in use, the diaphragm longitudinal axis extends downwardly from the urinal bowl.

Preferably, the diaphragm includes at least one crease or kink. A crease or kink improves the one-way properties of the duckbill valve and as such incorporating a crease or kink can permit a reduction in the length of the diaphragm without a loss of performance.

Preferably, there are a plurality of creases or kinks.

Preferably, the/each crease or kink is transverse to the diaphragm longitudinal axis.

Preferably, the diaphragm is polymeric.

Preferably, the diaphragm is injection moulded.

Preferably, the diaphragm comprises a flange.

Preferably, the flange extends radially outwards from a diaphragm inlet.

Preferably, the fitting further comprises a housing collar.

Preferably, the housing collar is releasably locatable within the housing throughbore.

Preferably, the housing collar is adapted to receive the diaphragm.

Preferably, the housing collar defines an inwardly extending lip adapted to engage the diaphragm flange.

Preferably, the housing collar is adapted to engage the housing body by a threaded connection.

Preferably, the housing body defines an internal thread for engaging an external thread defined by the housing collar.

Preferably, the housing collar is adapted to receive a urinal cartridge. A urinal cartridge provides a filtering function to prevent debris such as cigarette ends or chewing gum from entering the pipe work beneath the bowl and to a house a deodoriser to mask any odours which may be present.

Preferably, the fitting is adapted to be secured to a urinal bowl by co-operation between the housing collar and the housing body. In one embodiment, insertion of the housing collar, through the urinal outlet, into the housing body inlet and subsequent rotation of the collar, will draw the housing body up the collar thread, drawing the housing body and the housing collar together. This action sandwiches a portion of the urinal bowl thereby securing the fitting to the urinal bowl.

Preferably, the housing further comprises a clamp ring adapted to be releasably located within the housing collar.

Preferably the clamp ring is adapted to prevent axial movement of the diaphragm with respect to the housing body. The clamp ring prevents the diaphragm from becoming dislodged and in some cases assists in the prevention of vandalism and undesirable removal of the diaphragm.

Preferably the clamp ring is removable by a tool.

Preferably, the housing body further comprises an upper housing body portion and a lower housing body portion.

Preferably, the upper housing body portion is movable relative to the lower housing body portion.

Preferably, the upper and lower housing body portions are telescopically arranged.

Preferably, at least a section of the upper housing body portion slides within the lower housing body portion.

Preferably, the upper housing body portion is fixable with respect to the lower housing body portion. This means once the fitting dimensions have been adjusted to fit between the outlet bowl and the waste pipework, the dimensions of the fitting can be locked.

Preferably, the lower housing body portion defines a bend. A bend can be useful in assisting in the marrying up of the housing outlet to the existing pipe work.

Preferably, the housing body inlet is defined by the upper housing body portion and the housing body outlet is defined by the lower housing body portion.

Preferably, the diaphragm is mounted within the upper housing body portion.

Preferably, the lower housing body portion defines a continual flow path to ensure fluid flows around the bend. A continual flow path prevents puddling.

Preferably, the fitting further comprises a urinal cartridge.

Preferably, the urinal cartridge is removably connectable to the housing collar.

Preferably, the urinal cartridge is connectable to the housing collar by an interference fit.

In an alternative arrangement, the urinal cartridge is connectable to the housing collar by a threaded connection.

In a further alternative, the urinal cartridge is connectable to the housing collar by a bayonet or similar quick release fitting.

In one embodiment the urinal cartridge is lockable to the housing body and/or the housing collar. The urinal cartridge may be adapted to be pinned to the housing collar and/or the housing body.

The housing collar may be provided with lugs adapted to receive a locking pin.

In an alternative arrangement a bolt is provided to secure the urinal cartridge to the housing body and/or collar.

Preferably, the lock bolt threadingly engages a locking element which in turn engages the housing body and/or housing collar.

Preferably, the element engages lugs defined by the housing collar.

In one embodiment the urinal cartridge comprises a first cartridge portion and a second cartridge portion.

Preferably, the first cartridge portion is removable from the second cartridge portion.

Preferably, the second cartridge portion is releasably attachable to the housing collar.

The attachment mechanism between the first and second urinal cartridge portions and the connection between the second urinal cartridge portion and the housing collar may be different.

The first cartridge portion may comprise a deodoriser housing. This embodiment is advantageous if it is necessary to replace only a part of the urinal cartridge, for example, the deodoriser housing. If the deodoriser has, for example, evaporated. Being able to separate the deodoriser housing from the rest of the urinal cartridge reduces the use of materials.

According to a second aspect of the present invention, there is provided a urinal cartridge for use in a waterless or low water usage urinal, comprising:

a deodoriser housing portion; and a connection portion adapted to be connected to a urinal outlet;

wherein the deodoriser housing portion is releasably attachable to the connector portion by a first connection means and the connector portion is releasably attachable, in use, to the urinal outlet by a second connection means, the first and second connection means being different.

Providing a urinal cartridge, in accordance with an embodiment of the invention, permits part of the urinal cartridge to be removed, for example, during maintenance or, if necessary, the whole of the urinal cartridge to be removed. Having different connection methods means that if, for example, only the deodorising portion needs removal then a twisting action may be employed whereas if the entire urinal cartridge needs to be removed a pulling action may be employed.

According to a third aspect of the present invention, there is provided a sleeve for a waterless or low water usage urinal cartridge, the sleeve comprising:

a sleeve body; and a plurality of fingers, each finger extending downwardly from the sleeve body, each finger being non-linear.

Preferably, the sleeve is adapted to be received by a urinal cartridge. The sleeve is adapted to provide added filtration of the fluids flowing through the urinal cartridge.

Preferably, each finger defines a bend.

Preferably, the bend is located at an end of each finger.

Preferably, the finger bends in a radially outward direction.

Preferably, the fingers are resilient.

In one embodiment, the bending of the fingers permits the sleeve to be adjustable in height.

According to a fourth aspect of the present invention, there is provided a diaphragm through a waterless or low water usage urinal, the diaphragm comprising first and second walls defining a throughbore, the walls being biased together to a throughbore closed position and being movable under the pressure of a fluid to a throughbore open position, the walls at an inlet end of the diaphragm being formed apart by moulding.

Preferably, the diaphragm define at least one kink.

Preferably, the/each kink is transverse to a throughbore axis.

Preferably, the diaphragm is a one way valve.

According to a fifth aspect of the present invention there is provided an apparatus for a urinal, comprising:

a plate member adapted to form a seal with a urinal outlet, the plate member defining a throughbore permitting the passage of liquid, in use, from the urinal to a soil pipe; and a diaphragm located in the plate member throughbore, the diaphragm adapted to permit the passage of liquid through the throughbore in one direction only from the urinal to the soil pipe.

In one embodiment of the present invention a liquid barrier cartridge, of the type described for example in U.S. Pat. No. 5,711,037, can be replaced with an embodiment of the apparatus. The apparatus prevents the back flow of odours from the soil pipe without requiring the need for a liquid seal.

Preferably, the plate member, in use, defines part of the urinal surface.

Preferably, the plate member surface is defined to encourage liquid flowing across the plate member surface into the throughbore.

Preferably, the plate member surface is frusto-conical.

Preferably, the plate member comprises a seal.

Preferably, the seal comprises an edge seal extending around the peripheral edge of the plate member.

Preferably, the plate member is adapted to form a contact seal with urinal outlet.

Preferably, the seal is an elastomer.

Preferably, the seal is rubber.

Alternatively, the seal is polymeric.

The seal may be PVC.

The diaphragm may comprise a duckbill shaped valve, but may comprise other valve forms, for example, such as a rubber diaphragm.

The diaphragm may comprise a first flexible wall and a second flexible wall, the first and second flexible walls being arranged to define a diaphragm throughbore.

The first and second flexible walls may be arranged to normally lie in a diaphragm throughbore closed position in which the diaphragm throughbore is sealed. In this arrangement, the passage of fluid through the diaphragm from a diaphragm inlet to a diaphragm outlet opens the valve throughbore permitting passage of the fluid.

A diaphragm inlet may be held open by a diaphragm flange connected to an upper portion of the first and second flexible walls.

The diaphragm may comprise a polymeric material.

The diaphragm may be injection moulded or otherwise moulded.

In one embodiment, the diaphragm includes at least one crease or kink transverse to longitudinal valve axis. Incorporating a crease or kink biases the first and second flexible walls towards each other at the crease or kink, ensuring that a seal is maintained. Incorporating a crease or kink can permit a reduction in the length of the one-way diaphragm without a loss of performance.

Preferably, the plate member throughbore is adapted to receive a deodorising unit.

Preferably, the plate member throughbore is adapted to receive a filter.

Preferably, the filter and deodorising unit are combined. A filter unit prevents debris such as cigarette ends or chewing gum from entering the apparatus. A deodorising unit houses a deodoriser to mask any odours which may be present.

Preferably, the diaphragm is adapted to be removed through the plate member throughbore.

Preferably, the diaphragm is adapted to be removed, in use, upwardly through the plate member throughbore.

Preferably, the apparatus further comprises a collar adapted to form an interference fit with the throughbore.

Preferably, the collar is adapted to prevent the diaphragm from being removed from the throughbore.

Preferably, the apparatus further comprises a cup.

Preferably, the cup is adapted to be connected to the plate member and extend downwardly from the plate member.

Preferably, an upper portion of the cup defines a cup outlet.

Preferably, a lower end of the throughbore extends to beneath the cup outlet. Such an arrangement permits a liquid seal to form within the cup, providing a second barrier, in use, between the waste outlet and the soil stack.

Preferably, the apparatus further comprises a shroud.

Preferably, the shroud extends from a lower end of the throughbore and is adapted to house at least a portion of the diaphragm. In one embodiment, the shroud can assist in maintaining the shape of the diaphragm, and when used with a cup portion extends the depth of the liquid seal.

Preferably, the apparatus further comprises a skirt.

Preferably, the skirt depends downwardly from the plate member.

Preferably, the skirt depends downwardly from or adjacent an edge of the plate member.

Preferably, the skirt comprises an attachment device for attaching the apparatus to a urinal outlet. Particularly, the attachment device permits the apparatus to be attached in the chamber of a existing liquid barrier cartridge type outlet.

Preferably, the attachment device is at least one lug for engaging a channel defined by a urinal outlet.

According to a sixth aspect of the present invention there is provided an apparatus for a urinal, comprising:

a plate member adapted to form a seal with the urinal outlet, the plate member defining a throughbore permitting the passage of liquid, in use, from the urinal to a soil pipe, the throughbore having an inlet and an outlet; and a cup member extending downwardly from the plate member, the cup member having an outlet;

wherein, in use, the throughbore outlet is beneath the cup outlet such that the liquid seal can be formed between the throughbore inlet and the cup outlet.

In one embodiment of the present invention, a liquid barrier cartridge of the type described, for example, in U.S. Pat. No. 5,711,037, can be replaced with an embodiment of the apparatus. The apparatus, when used with a liquid, provides a liquid seal which prevents the backflow of odours from the soil pipe.

The apparatus may further comprise a diaphragm adapted to permit the passage of liquid through the throughbore in one direction only from the urinal to the soil pipe. Provision of a diaphragm provides a second seal.

Preferred features listed with respect to one aspect may be applicable to other aspects and have not been repeated for brevity.

BRIEF DESCRIPTION OF THE DRAWINGS

Embodiments of the present invention will now be described with reference to the accompanying drawings in which.

DETAILED DESCRIPTION OF THE DRAWINGS

Figure 1:
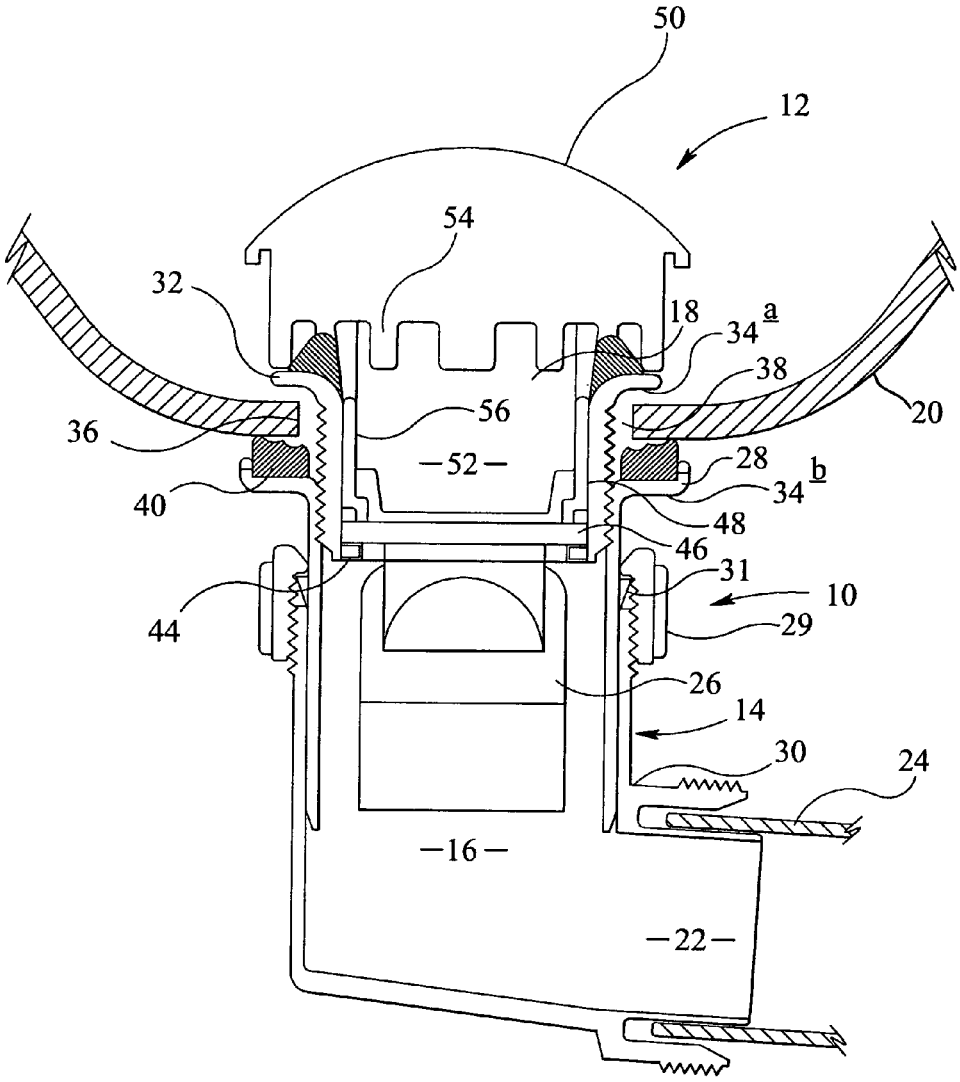
FIG. 1 is a section view of a fitting and a urinal cartridge according to a first embodiment of the present invention.
Figure 2:
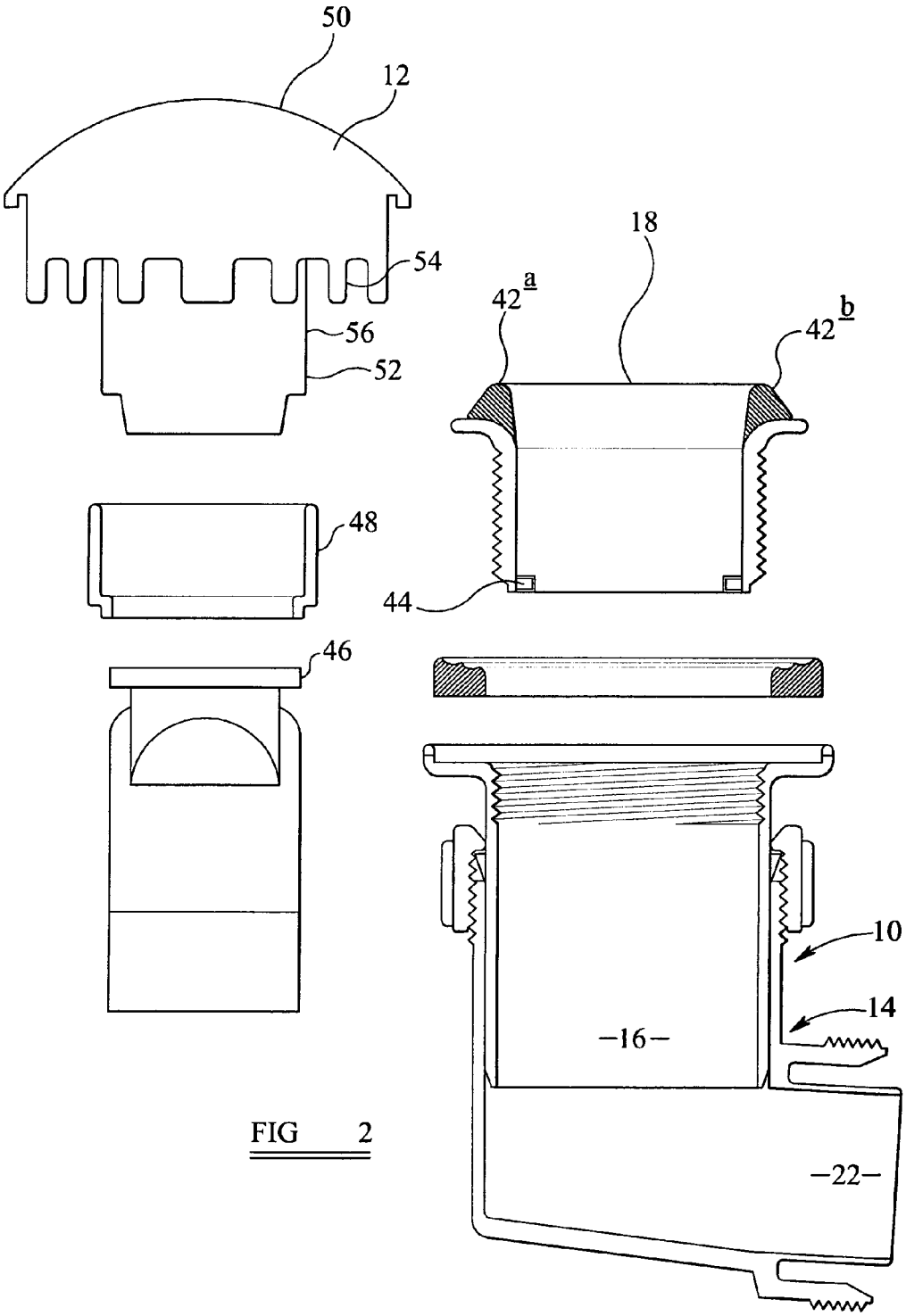
FIG. 2 is a partially excluded view of the fitting and urinal cartridge of FIG. 1.

Referring firstly to FIGS. 1 and 2, there is shown a section view (FIG. 1) and a partially exploded view (FIG. 2) of a fitting, generally indicated by reference numeral 10, and a urinal cartridge 12, according to a first embodiment of the present invention. The fitting 10 comprises a housing body 14 defining a throughbore 16, the throughbore 16 having an inlet 18 adapted to receive liquid from a urinal bowl 20 (shown in FIG. 1) and an outlet 22 adapted to be connected to a waste pipe 24.

The fitting 10 further comprises a diaphragm 26 removably locatable within the housing body throughbore 16. The diaphragm 26 permits the passage of a liquid through the throughbore 16 in one direction only from the inlet 18 to the outlet 22.

The housing 14 comprises an upper housing body portion 28 and a lower housing body portion 30. The upper housing body portion 28 can slide within the lower housing body portion 30 to permit relative movement of the housing outlet 22 with respect to the housing inlet 18. Relative movement between the upper housing body portion 28 and the lower housing body portion 30, permits the dimensions of the fitting 10 to be adjusted to fit between the bow outlet 38 and the waste pipe 24. Once the correct dimension has been selected, relative movement of the upper housing portion 28 with respect to the lower housing portion 30 can be prevented by means of a nut 29 and a compression seal 31. The nut 29 is threadedly connected to the lower housing portion 30. Tightening the nut 29 against the compression seal 31 prevents relative movement between the upper and lower housing body portions 28,30.

The fitting 10 further comprises a housing collar 32. The housing collar 32 is in a threaded engagement with the upper housing body portion 28. Both the housing collar 32 and the upper housing portion 28 define radially outwardly extending flanges 34*a*,34*b*. The purpose of these flanges 34 is to trap an edge 36 of an outlet 38 defined by the urinal bowl 20. Because of the threaded engagement, rotation of the housing collar 32 with respect to the upper housing portion 28 will draw the collar 32 and the upper housing 28 together trapping the urinal outlet edge 36 between the flanges 34*a*,34*b* thereby securing the fitting to the urinal bowl 20. To ensure a seal between the fitting 10 and the urinal bowl 20, a compression ring seal 40 is provided on the upper housing portion flange 34*b*.

To facilitate rotation of the housing collar 32 with respect to the upper housing portion 28, a pair of lugs 42*a*,42*b* are provided on an upper surface of the collar 32. To rotate the housing collar a user can grasp the lugs 42.

The housing collar 32 further defines a radially inwardly extending lip 44 which provides a seat for the diaphragm 26. The diaphragm 26 includes a rim 46 for engaging the housing collar lip 44. This arrangement permits the diaphragm 26 to be removably locatable within the housing throughbore 16 and permits the diaphragm 26 to be removed from the housing 10 through the urinal bowl outlet 38. This means the diaphragm 26 can be removed without the need for disconnecting the fitting 10 from the urinal bowl 20.

The fitting 10 further comprises a clamp ring 48 adapted to form an interference fit with the collar 32 and to clamp the diaphragm 26 in place, that is in engagement with the rim 44.

Once located in the bowl outlet 38, the fitting 10 is adapted to receive a urinal cartridge 12. The urinal cartridge 12 comprises a head portion 50 and a stalk 52. Within the head portion 50 is a deodorising material (not visible) for masking the smell of, for example, urine in the pipe work 24. The head portion 50 comprises a coarse grill 54 adapted to engage the housing collar 32 such that the cartridge head 50 and the housing collar 32 defines a filter to prevent foreign objects such as chewing gum or cigarette butts entering the trap.

The stalk 52 defines an external surface 56 adapted to form an interference fit with the clamp ring 48.

Figure 3:
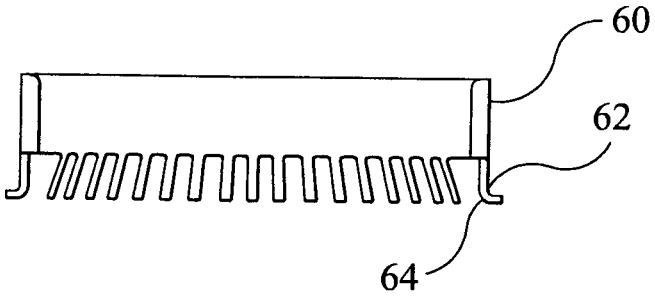
FIG. 3 is a section view of a filter sleeve for use with the urinal cartridge of FIG. 1 according to a second embodiment of the present invention.
Figure 4:
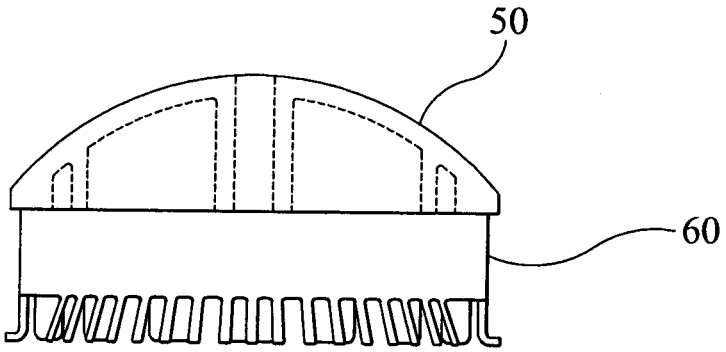
FIG. 4 is a front view of the filter sleeve of FIG. 3 shown in use with part of the urinal cartridge of FIG. 1.

Reference is now made to FIGS. 3 and 4, a section view through (FIG. 3) and a front view (FIG. 4) of a filter sleeve 16 according to a second embodiment of the present invention.

The purpose of the sleeve 60 is to fit around the outside of the cartridge grill 54 (shown in FIG. 4) to provide an additional layer of filtration.

The sleeve 60 comprises a plurality of downwardly depending fingers 62, each finger 62 being non-linear and defining a bend 64. The sleeve 60 is made of a resilient material and, when used with a urinal cartridge 12, are engaged with a urinal bowl outlet 38. The sleeve 60 can be adjusted by sliding towards or away from the outlet 38 to provide a suitable degree of filtration. As the fingers 62 will bend upon engagement with the bowl outlet 38, fine adjustment and accurate fitting of the sleeve 60 is not essential.

Figure 6:
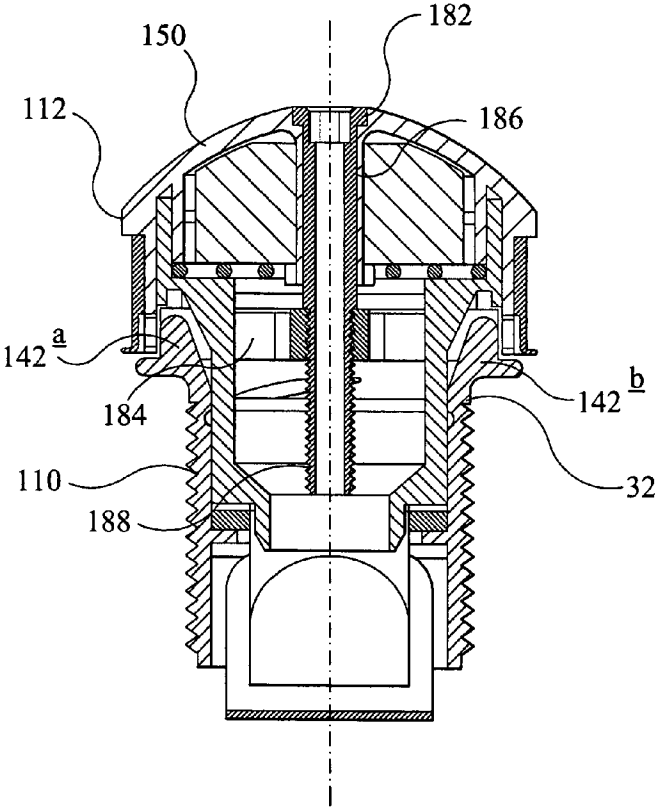
FIG. 6 is a section view of the fitting and urinal cartridge of FIG. 5.
Figure 5:
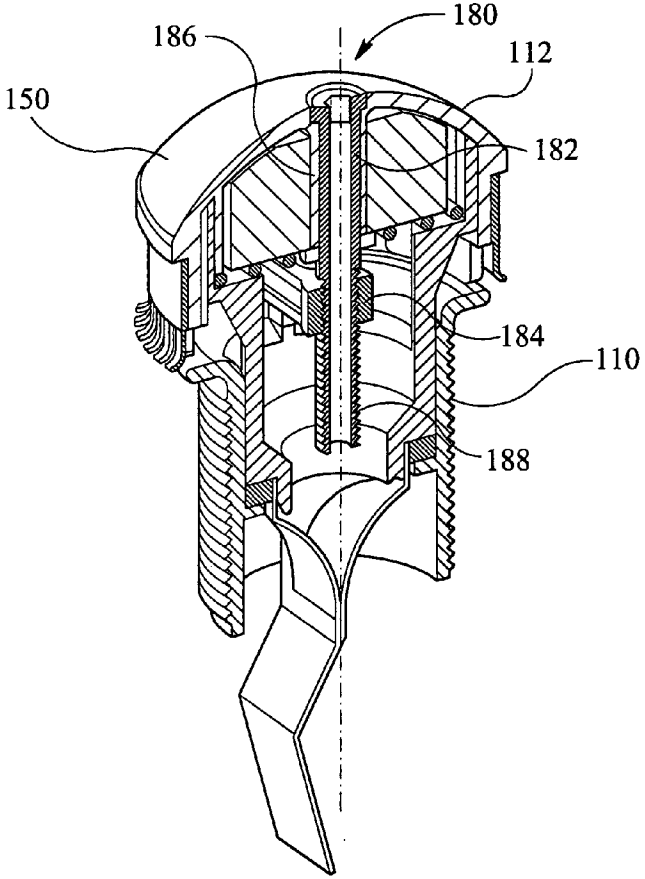
FIG. 5 is a perspective section view of a fitting and a urinal cartridge according to a further embodiment of the present invention.

Reference is now made to FIGS. 5 and 6, a perspective section view (FIG. 5) and a section view (FIG. 6) of a fitting 110 and a urinal cartridge 112, according to a third embodiment of the present invention.

Figure 7:
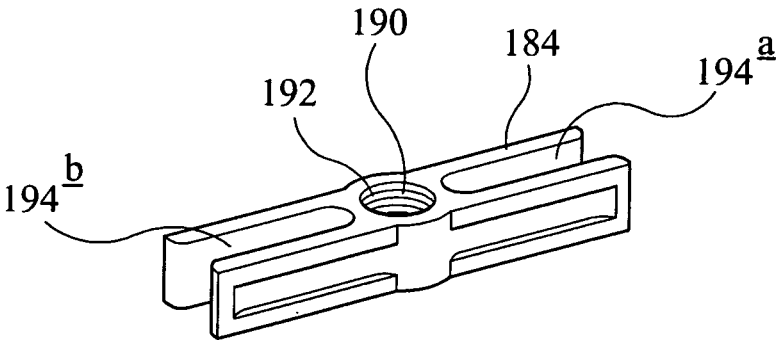
FIG. 7 is a perspective view of the locking element of FIG. 5.

The fitting and urinal cartridge 110,112 are generally of similar construction to the fitting and urinal cartridge, 10,12 of FIGS. 1 to 4. However, the arrangement shown in FIGS. 5 and 6 includes locking mechanism 180 for securing the urinal cartridge 112 to the fitting 110. The locking mechanism 180 comprises a locking bolt 182 and a locking element 184. The locking element 184 is best seen in FIG. 7, a perspective view of the locking element 184.

The locking bolt 182 fits through an aperture 186 defined by the urinal cartridge head portion 150. The locking bolt 182 defines an external thread 188 which engages with an internal thread 190 (FIG. 7) defined by a locking element aperture 192. The locking element 184 defines first and second recesses 194*a*,194*b* which engage the housing collar tugs 142*a*,142*b* (FIG. 6). Once the locking bolt 182 is threadingly engaged with the locking element 184 and the locking element 184 is in turn engaged with housing collar 32 by means of the element recesses 194 engaging the collar lugs 142, then the urinal cartridge 112 is releasably secured to the fitting 110.

Various modifications and improvements may be made to the above described embodiments without departing from the scope of the invention. For example, although the clamp ring 48 is shown forming an interference fit with the housing collar 32, another suitable form of connection can be employed such as a threaded connection or bayonet fitting. Similarly, the housing stalk 52 is shown forming an interference fit with the clamp ring 48. If a clamp ring of reduced height was used, the stalk 52 could be connected directly to the housing collar 32 by an interference fit, bayonet fitting, threaded connection or any suitable connection.

Figure 8:
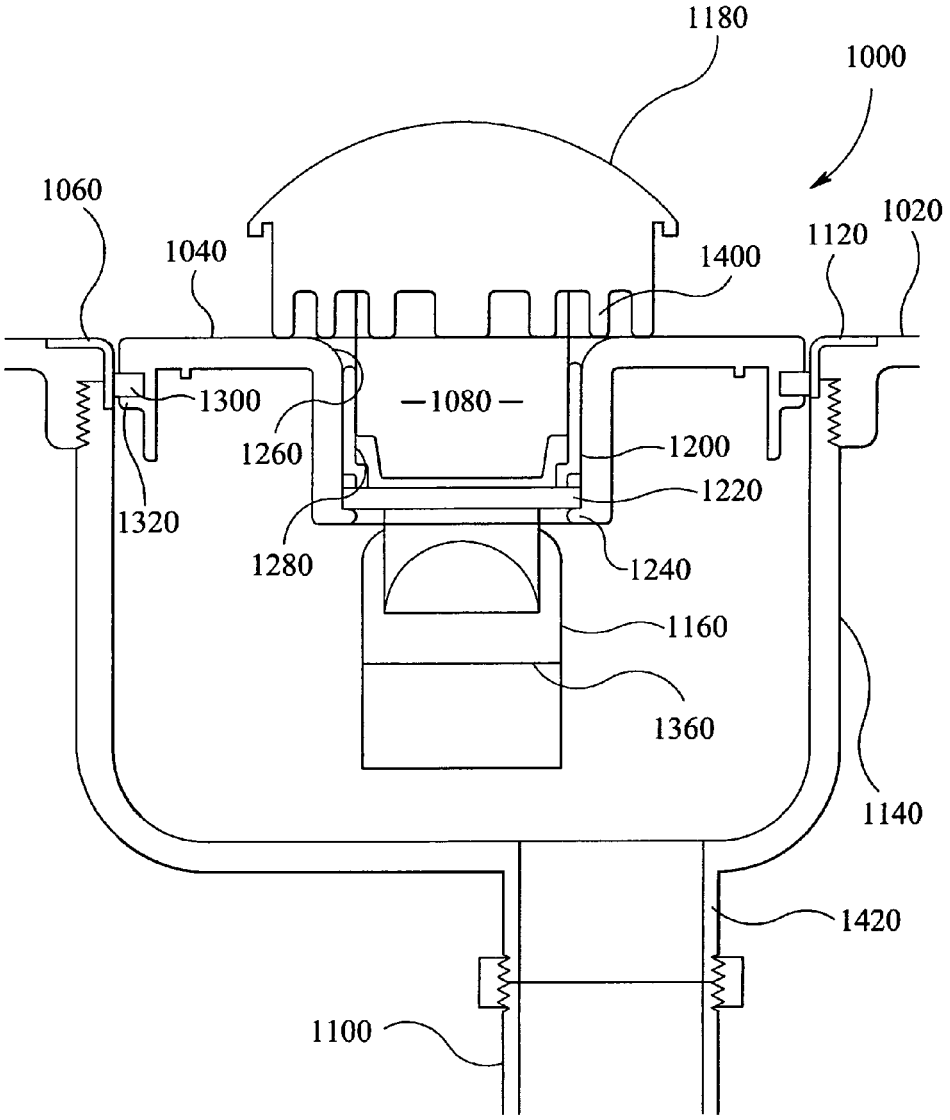
FIG. 8 is a section view of an apparatus for a urinal according to a an embodiment of the invention.

Reference is now made to FIG. 8, a section view of an apparatus, generally indicated by reference numeral 1000 for a urinal 1020 according to an embodiment of the present invention. The apparatus 1000 comprises a plate member 1040 adapted to form a seal with a urinal outlet 1060, the plate member 1040 defining a throughbore 1080 permitting the passage of liquid (not shown) from the urinal 1020 to a soil pipe 1100.

The urinal outlet 1060 comprises a flange 1120 and a chamber 1140. The flange and chamber 1120,1140 are intended, in conventional use, to receive a cartridge containing a liquid seal, such as an oil seal. The apparatus 1000 is intended to replace the cartridge. This provides a solution which is more environmentally friendly.

The plate member 1040 further includes a peripheral seal 1300 which sealingly engages the outlet flange 1120. The peripheral seal 1300 is an elastomeric seal and sits in a recess 1320 defined by the plate member 1040.

The apparatus 1000 further comprises a diaphragm 1160 located in the plate member throughbore 1080, the diaphragm 1160 adapted to permit the passage of liquid through the throughbore 1080 in one direction only, from the urinal 1020 to the soil pipe 1100.

The apparatus 1000 further comprises a filter/deodorising unit 1180 and a collar 1200. As can been seen a diaphragm flange 1220 rests on a throughbore lip 1240. This arrangement permits, in the absence of the filter/deodorising unit 1180 and the collar 1200, the removal of the diaphragm 1160 from the apparatus 1000 through the throughbore 1080. The collar 1200 is provided to pin the diaphragm 1160 to the throughbore lip 1240. The collar 1200 forms interference fit with a throughbore internal surface 1260.

The filter/deodorising unit 1180 in turn forms an interference fit with a collar internal surface 1280.

Figure 9:
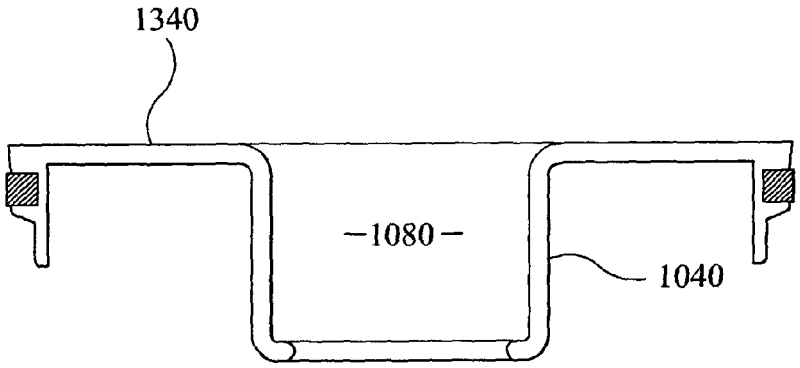
FIG. 9 is a section view of the plate member of FIG. 8.
Figure 10:
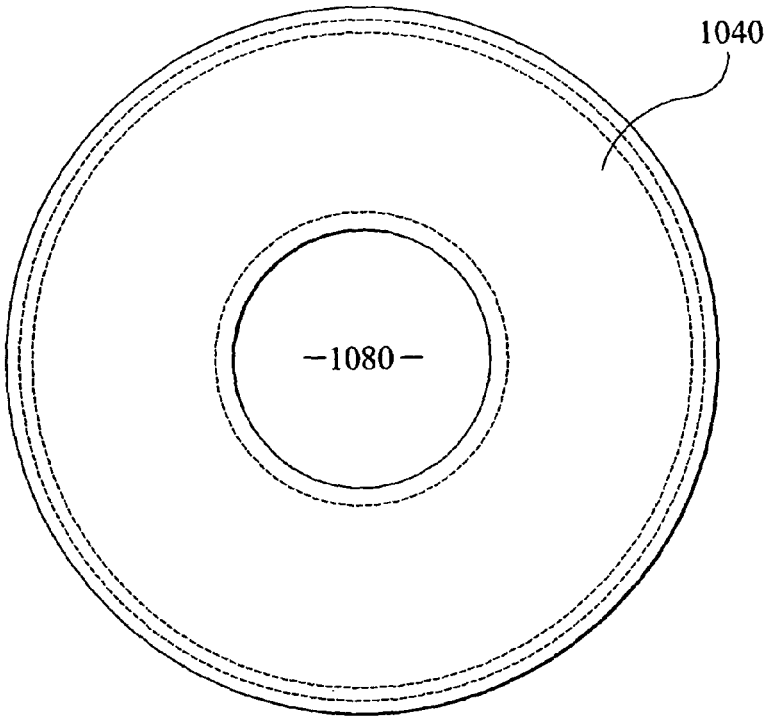
FIG. 10 is a top view of the plate member of FIG. 8.

Referring to FIGS. 9 and 10, additional features of the plate member. 1040 can be seen. Firstly, it will noted that the plate member 1040 is a circular disc with the throughbore 1080 located centrally within the disc. Additionally, it will be noted, particularly on FIG. 9, that the plate member upper surface tapers towards the throughbore 1080 to facilitate transfer of liquid from the urinal bowl 1020 into the throughbore 1080.

Referring back to FIG. 8, the passage of liquid through the apparatus 1000 will now be described. Liquid flowing dawn the urinal 1020 will pass across the flange 1120 onto the plate member 1040. Any large debris such as chewing gum or cigarette butts will be filtered from the liquid by a series of teeth 1400 provided on the filter/deodorising unit 1180. The filtered liquid then flows into the throughbore 1080 and down into the diaphragm 1160. The liquid passes through diaphragm 1160 and leaves the urinal chamber 1140 by a passage 1420 connected to the soil pipe 1100.

The diaphragm 1160 incorporates a kink 1360 which provides a seal across the diaphragm 1160.

Figure 11:
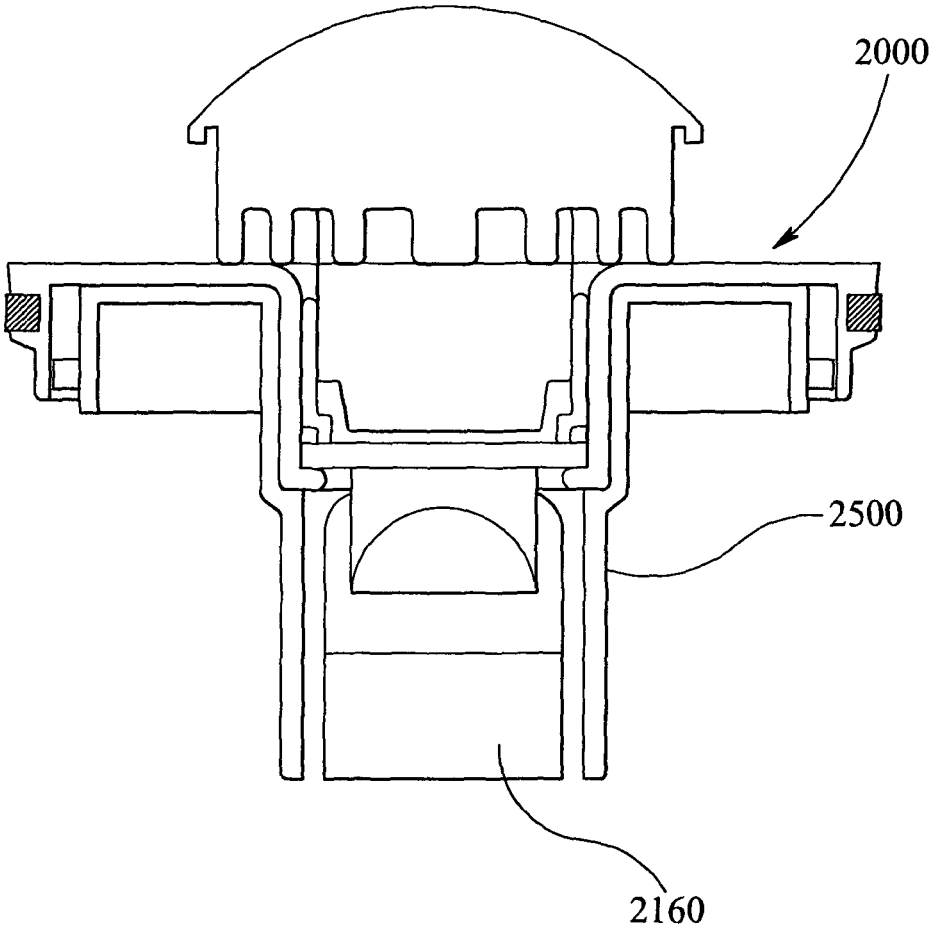
FIG. 11 is a section view of an apparatus for a urinal according to an embodiment of the invention.

Reference is now made to FIG. 11 which shows a section view of an apparatus 2000 according to a further embodiment of the present invention. The apparatus 2000 is essentially the same as the apparatus 1000 of the previous embodiment however the apparatus 2000 of the further embodiment incorporates a shroud 2500 adapted to maintain the orientation of the diaphragm 2160 to assist in efficient operation of the apparatus 2000.

Figure 12:
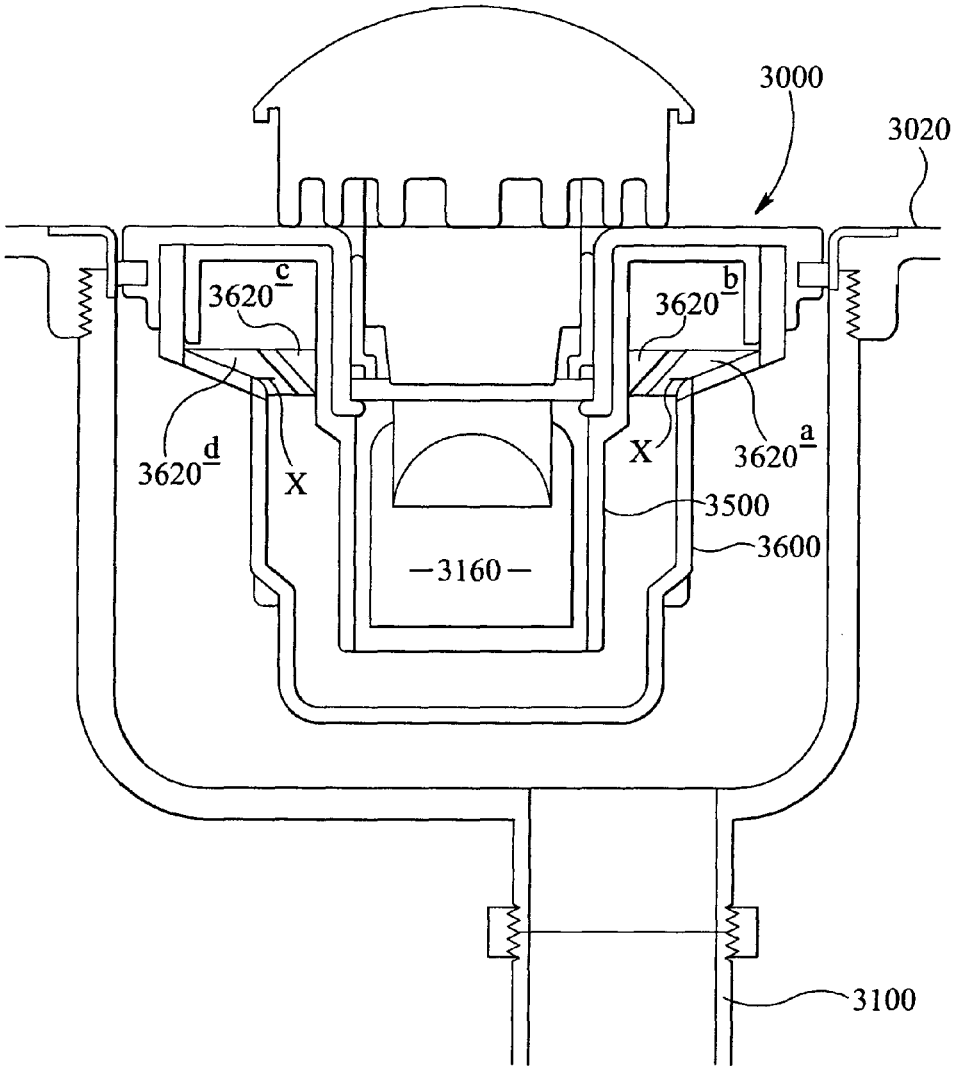
FIG. 12 is a section view of an apparatus for a urinal according to an embodiment of the invention.

Referring now to FIG. 12, there is shown a section view of an apparatus 3000 according to a further still embodiment of the present invention.

In this embodiment, the apparatus 3000 further comprises a cup 3600. The cup 3600 has a series of cup outlets 3620 of which four 3620*a*,3620*b*,3620*c*,3620*d* are shown. The purpose of the cup 3600, in combination with the shroud 3500 is to assist in the formation of a liquid seal. The liquid may be, for example, urine or it may be water if the urinal includes the facility to provide water. In use, water will fill the cup 3600 up to the level marked 'X' at the lower end of the cup outlets 3620. The provision of both the liquid seal and the diaphragm seal 3160 provides a double protection against odours from the soil pipe 3100. The diaphragm 3160 will also act as a backup in the event that the liquid in the cup 3600 dries up or is sucked away due to pressure differential across the apparatus 3000.

Figure 13:
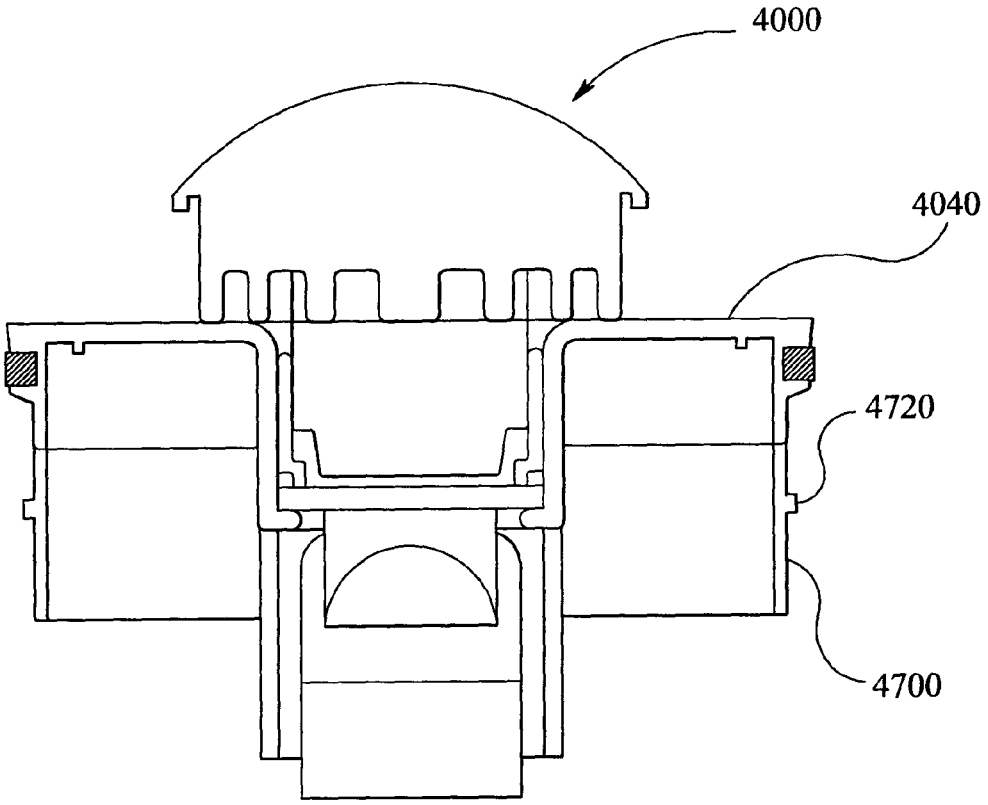
FIG. 13 is a section view of an apparatus for a urinal according to a fourth embodiment of the present invention.

Referring now to FIG. 13, there is shown a section view of an apparatus 4000 according to an embodiment of the present invention.

In this embodiment, the apparatus 4000 further comprises a skirt 4700, the skirt downwardly depending from an edge of the plate member 4040.

The skirt 4700 defines attachment means 4720 for attaching the apparatus 4000 to a chamber (not shown) of the type shown in FIG. 1. To facilitate attachment, the chamber could be provided with first and second channels, adapted to receive the lugs 4720 in a bayonet type fitting.

Various modifications and improvements may be made to the above described embodiments without departing from the scope of the invention. For example, the plate member, shroud and cup combination of the last embodiment could be provided without the diaphragm. This would permit a water trap apparatus to be retro-fitted into a urinal which is designed to receive a cartridge unit incorporating a sealing liquid, such as an oil.

The invention claimed is:

1. A fitting for connecting a urinal to a waste pipe, said urinal having a urinal bowl outlet, said fitting comprising:

a housing body defining a housing body throughbore, the housing body having a housing body inlet adapted to receive liquid from said urinal bowl outlet and a housing body outlet adapted to be connected to said waste pipe;

a housing collar adapted for engaging the urinal bowl outlet, said housing collar being releasably locatable within the housing body throughbore, the housing collar defining a housing collar throughbore for receiving liquid from the urinal bowl outlet and an inwardly extending lip;

a diaphragm removably locatable in the housing body throughbore, the diaphragm comprising a duckbill shaped valve comprising a first flexible wall and a second flexible wall, the first and second flexible walls being arranged to define a diaphragm throughbore, the first and second flexible walls being arranged to normally lie in a diaphragm throughbore closed position in which the diaphragm throughbore is sealed, the diaphragm adapted to permit the passage of liquid through the housing body throughbore in one direction only from the housing body inlet to the housing body outlet;

wherein, in use with a urinal bowl, the diaphragm is removable from the housing body throughbore through the housing collar throughbore; and wherein said diaphragm comprises a diaphragm inlet, said diaphragm inlet held open by a diaphragm flange connected to an upper portion of the first and second flexible walls, said diaphragm flange extending radially outwards from the diaphragm inlet such that the first and second flexible walls are spaced from the housing body throughbore, wherein the inwardly extending lip of the housing collar is adapted to provide a seat for the diaphragm flange;

a clamp ring adapted to be releasably locatable within the housing collar throughbore, the clamp ring defining a clamp ring throughbore for permitting the passage of liquids therethrough, the clamp ring being adapted to trap the diaphragm flange between the clamp ring and the inwardly extending lip so as to prevent axial movement of the diaphragm with respect to the housing body; and a urinal cartridge, the urinal cartridge comprising a head portion and a stalk extending downwardly from the head portion, wherein the clamp ring is adapted to receive at least a portion of the stalk within the clamp ring throughbore so as to support the stalk within the clamp ring throughbore and so as to support the head portion above the urinal bowl outlet.

2. A fitting according to claim 1, wherein the diaphragm is a duckbill valve.

3. A fitting according to claim 1, wherein the diaphragm has a diaphragm longitudinal axis, the diaphragm longitudinal axis being parallel to a throughbore longitudinal axis, in use, the diaphragm longitudinal axis extending downwardly from the urinal bowl.

4. A fitting according to claim 1, wherein the diaphragm has a longitudinal axis, wherein the diaphragm includes at least one crease or kink, the/each crease or kink being transverse to the diaphragm longitudinal axis.

5. A fitting according to claim 1 wherein the housing collar is adapted to engage the housing body by a threaded connection, the housing body defining an internal thread for engaging an external thread defined by the housing collar.

6. A fitting according to claim 1 wherein the urinal cartridge is adapted for preventing debris entering said waste pipe and for housing a deodoriser.

7. A fitting according to claim 1, wherein the fitting is adapted to be secured to said urinal bowl by co-operation between the housing collar and the housing body, the fitting being configured such that insertion of the housing collar, through the urinal bowl outlet, into the housing body inlet and subsequent rotation of the housing collar, will draw the housing body up the collar thread, drawing the housing body and the housing collar together.

8. A fitting according to claim 1 wherein the clamp ring is removable by a tool.

9. A fitting according to claim 1 wherein the housing body comprises an upper housing body portion and a lower housing body portion, the upper housing body portion being movable relative to the lower housing body portion, at least a section of the upper housing body portion being slideable within the lower housing body portion.

10. A fitting according to claim 9 wherein the upper housing body portion is fixable with respect to the lower housing body portion.

11. A fitting according to claim 1 wherein the fitting further comprises a urinal cartridge, the urinal cartridge being removably connectable to a housing collar by an interference fit, or a threaded connection, or a bayonet/quick release fitting.

12. A fitting according to claim 11, in which the urinal cartridge comprises a first cartridge portion and a second cartridge portion, the first cartridge portion being removable from the second cartridge portion, the second cartridge portion being releasably attachable to the housing collar wherein the attachment mechanism between the first and second urinal cartridge portions and the connection between the second urinal cartridge portion and the housing collar is different.

13. A sleeve for a waterless or low water usage urinal cartridge, the sleeve adapted to provide added filtration of fluids flowing through the urinal cartridge, the sleeve comprising:

a sleeve body; and a plurality of fingers, each finger extending downwardly from the sleeve body, each finger defining a radially outward bend located at an end of each finger and above an outlet of a urinal bowl, and each finger being vertically aligned with and extending downwardly from the sleeve body;

wherein the sleeve is adapted to fit around the outside of a grill of the urinal cartridge to provide an additional layer of filtration in addition to the filtration provided by the grill of the urinal cartridge, wherein bending of the fingers permits the sleeve to be adjustable in height by allowing the fingers to slide on the urinal bowl transverse to the height of the sleeve to allow a relative height of the sleeve and the urinal bowl to be adjustable whilst maintaining contact between the fingers and the urinal bowl for filtration.

14. A fitting for an outlet of a urinal, the fitting being adapted for receiving liquid from the urinal and permitting said liquid to exit a waste pipe, said fitting comprising:

a housing collar adapted for engaging the urinal outlet, said housing collar being releasably locatable within the urinal outlet, the housing collar defining a housing collar throughbore for receiving liquid from the urinal outlet and an inwardly extending lip;

a diaphragm removably locatable in the housing collar throughbore, the diaphragm comprising a duckbill shaped valve comprising a first flexible wall and a second flexible wall, the first and second flexible walls being arranged to define a diaphragm throughbore, the first and second flexible walls being arranged to normally lie in a diaphragm throughbore closed position in which the diaphragm throughbore is sealed, the diaphragm adapted to permit the passage of liquid through the housing collar throughbore, wherein the diaphragm is removable from the housing collar through the housing collar throughbore, wherein said diaphragm comprises a diaphragm inlet, said diaphragm inlet held open by a diaphragm flange connected to an upper portion of the first and second flexible walls, said diaphragm flange extending radially outwards from the diaphragm inlet such that the first and second flexible walls are spaced from the housing collar throughbore, wherein the inwardly extending lip of the housing collar is adapted to provide a seat for the diaphragm flange;

a clamp ring adapted to be releasably locatable within the housing collar throughbore, the clamp ring defining a clamp ring throughbore for permitting the passage of liquid therethrough, the clamp ring being adapted to trap the diaphragm flange between the clamp ring and the inwardly extending lip so as to prevent axial movement of the diaphragm with respect to the housing collar; and a urinal cartridge, the urinal cartridge comprising a head portion and a stalk extending downwardly from the head portion, wherein the clamp ring is adapted to receive at least a portion of the stalk within the clamp ring throughbore so as to support the stalk within the clamp ring throughbore and so as to support the head portion above the urinal outlet.

* * * * *